United States Patent [19]

Crowden

[11] Patent Number: 4,872,675

[45] Date of Patent: Oct. 10, 1989

[54] BASEBALL PITCHING DEVICE

[76] Inventor: Horace Crowden, Rte. 2, Box 12, Sheffield, Ala. 35661

[21] Appl. No.: 15,641

[22] Filed: Feb. 17, 1987

[51] Int. Cl.[4] ..... A63B 69/38

[52] U.S. Cl. ..... 273/26 E

[58] Field of Search ..... 273/26 E, 58 C, 29 R, 273/185 C, 185 B, 200 A, 200 B, 414, 413

[56] References Cited

U.S. PATENT DOCUMENTS

| | | | |
|---|---|---|---|
| 2,547,776 | 4/1951 | Rankin | 273/26 E |
| 2,606,025 | 8/1952 | Horning | 273/26 E |
| 2,626,502 | 12/1971 | Well | 273/26 E |
| 3,333,847 | 8/1967 | Pennington | 273/26 E |
| 3,885,790 | 5/1975 | Parr | 273/26 E |
| 3,893,669 | 7/1975 | Myers | 273/26 E |
| 4,647,042 | 3/1987 | Bruce | 273/26 E |

FOREIGN PATENT DOCUMENTS

| | | | |
|---|---|---|---|
| 712035 | 6/1965 | Canada | 273/26 E |
| 19786 | of 1908 | United Kingdom | 273/26 C |

*Primary Examiner*—Edward M. Coven
*Assistant Examiner*—T. Brown
*Attorney, Agent, or Firm*—Martin R. Greenstein; Phillip J. Zadeik; David I. Roche

[57] ABSTRACT

The invention relates to a device which presents a batter with a moving ball simulating a ball which has been thrown or pitched. The device is designed to swing a tethered ball in a substantially horizontal path, thereby presenting a batter with a moving baseball. The tether extends through a hollow shaft and has one of its ends attached to a ball and its other end attached to a clamp; the clamp being adjustable along the outer surface of the hollow shaft. The shaft is supported on a base and is rotatable relative to the base by a motor.

16 Claims, 2 Drawing Sheets

BASEBALL PITCHING DEVICE

TECHNICAL FIELD

This invention relates to a device for practicing hitting a moving baseball. More particularly, the invention relates to a device which presents a batter with a moving ball simulating a ball which has been thrown or pitched. In one specific aspect, the invention relates to a device which swings a tethered ball in a circular fashion, thereby regularly presenting the batter with a moving baseball.

BACKGROUND OF THE INVENTION

Striking or hitting a moving ball with a bat is one of the most, if not the most, difficult acts to perform in all of sports. Hitting a moving ball requires tremendous eye hand coordination, particularly when the ball is moving at a great rate of speed. Professional baseball pitchers, for example, often throw a baseball toward the batter at speeds in excess of 100 miles per hour.

Hitters must, therefore, practice a great deal to improve their eye hand coordination and develop a consistent and effective swing. "Batting practice" is an important part of any hitters preparation for competition. Generally, such practice involves a human pitcher who throws or hurls balls in succession to the batter, as would happen in real competition. Accurately and consistently throwing a ball to a batter, however is also a difficult task and inaccurate and/or inconsistent pitches detract significantly from the efficacy of batting practice. Human pitchers also tire meaning that—during the course of batting practice—different individuals need to throw the ball. Batting practice also requires fielders to retrieve the balls struck by the hitter and to return them to the pitcher. If only a limited number of balls are available, batting practice is slowed down and delayed as balls are retrieved and returned to the pitcher.

For many reasons, mechanical devices for throwing or hurling baseballs to a hitter for batting practice have been developed. Balls are fed into the pitching machine—manually or automatically—and the device regularly pitches balls at a predetermined speed and direction. These devices are useful because they dispense with the need for the often inaccurate and inconsistent human pitcher.

However, these machines have many disadvantages and drawbacks. In manually loaded machines, an operator must feed the balls to be pitched one by one into the machine. Even in automatically fed machines the balls, after being struck (or missed) by the batter, must be collected and reloaded into the feed portion of the mechanism. Fielders must be available to retrieve the batted balls which means that it is difficult, if not impossible, for the batter to practice without some assistance, even indoors.

Finally, the pitching machines described above are generally heavy, bulky, cumbersome and difficult to set up.

Hence, devices have been developed which allow the batter to practice hitting by himself without the need for assistance in feeding and retrieving the balls. For example, Parr, in U.S. Pat. No. 3,885,790 discloses a device wherein the ball to be struck is tethered to the end of a rope, which swings in a circular fashion. The device, therefore, presents the batter, who stands at one point on the path of the ball's motion, with a simulated "pitch". This device dispenses not only with the need for a human pitcher, but dispenses with the need for fielders to retrieve and reload the pitching machine.

However, such devices, including Parr, have numerous disadvantages. Most devices are mechanically complicated, making the device expensive to manufacture and impractical to use. Other devices are large and bulky making them difficult to set up, particularly by one person.

Other machines have unduly complex adjustments, or cannot be adjusted with any degree of ease. Therefore, it is difficult for batters of different height, size and/or skill level to use the machines, which—in order to be effective—must be adjustable depending on the batter involved. Some machines do not reset quickly, meaning that once the ball is struck by the batter, there is a long delay before the machine is reset and the ball returns to the predetermined circular path. Other machines are prone to mechanical failure, because they are poorly designed to handle the forces placed upon them during use.

My invention discloses a well designed, completely adjustable, relatively lightweight pitching machine. The batter is regularly presented with a simulated pitch and the machine resets quickly once the ball has been struck. The device is durable and it is easy to set up and transport.

SUMMARY OF THE INVENTION

The pitching device of this invention utilizes an innovative design which includes an easily adjusted spring rotational means, and base. In the preferred embodiment, the device is relatively lightweight and can be broken down into easy-to-carry component parts. The device recovers quickly after the ball is struck, allowing for only a relatively short delay before the batter is once again able to swing at the ball.

BRIEF DESCRIPTION OF THE DRAWING

The invention is illustrated more or less diagrammatically in the accompanying drawing wherein.

DETAILED DESCRIPTION OF THE PREFERRED EMBODIMENT

Like reference numbers will be used to refer to like parts from Figure to Figure in the following description of the preferred embodiment of the invention.

Figure 1:
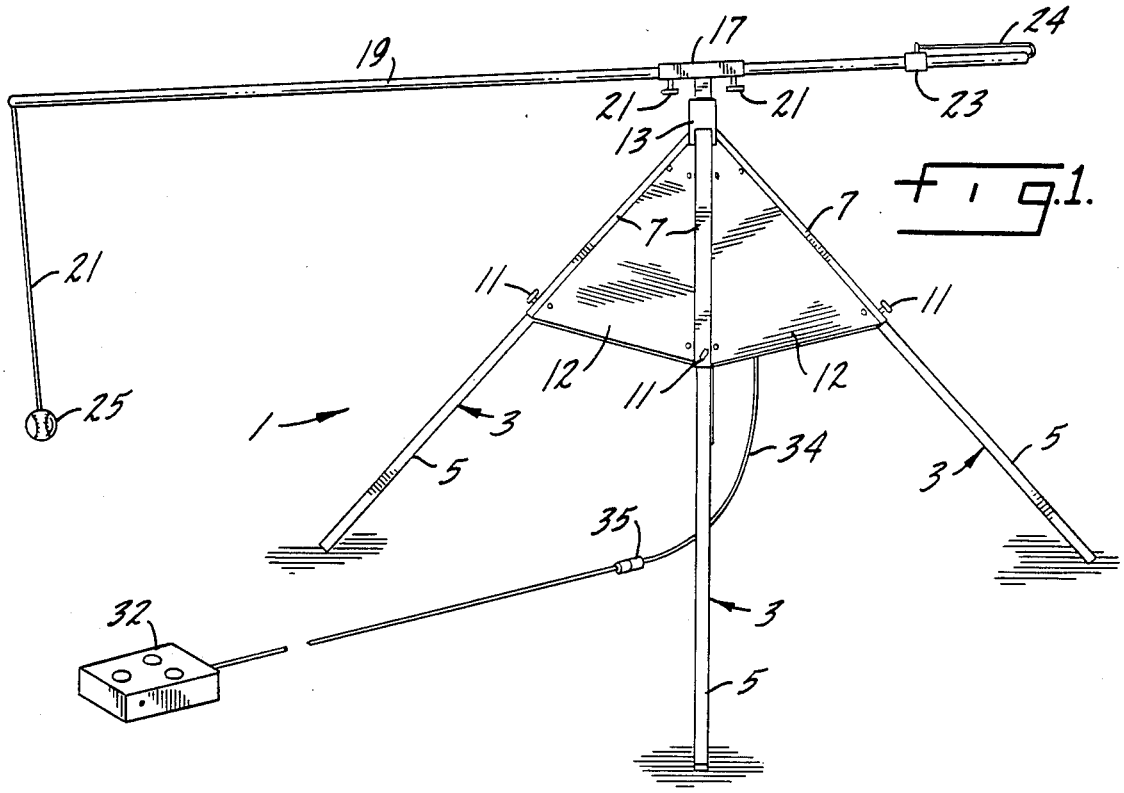
FIG. 1 is a perspective view of the preferred embodiment of the invention, disclosing the pitching device as it would typically appear just prior to use.

The pitching device is indicated generally at 1 in FIG. 1. As can be seen by this figure, the device is supported by legs 3. Each support leg comprises a lower insert member 5 and an upper receiving member 7. The lower insert member 5 is slidably mounted inside the upper receiving member 7 and releasably secured thereto by clamp 11. Since each support leg 3 can be independently adjusted by means of clamp 11, the pitching device can be raised, lowered, or tilted. Each support leg can also be shortened or disassembled for easy transportation and storage.

Figure 2:
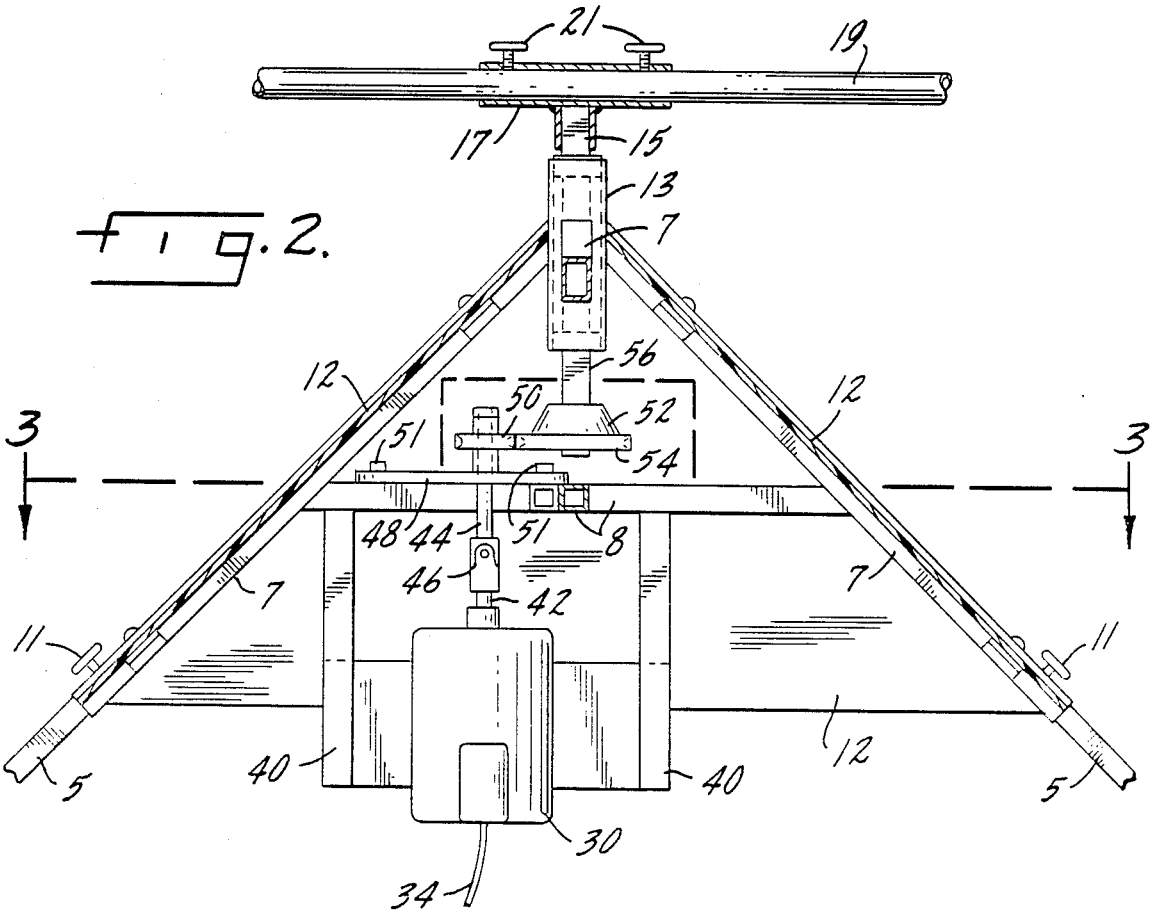
FIG. 2 is a view to an enlarged scale of the pitching device drive mechanism.
Figure 3:
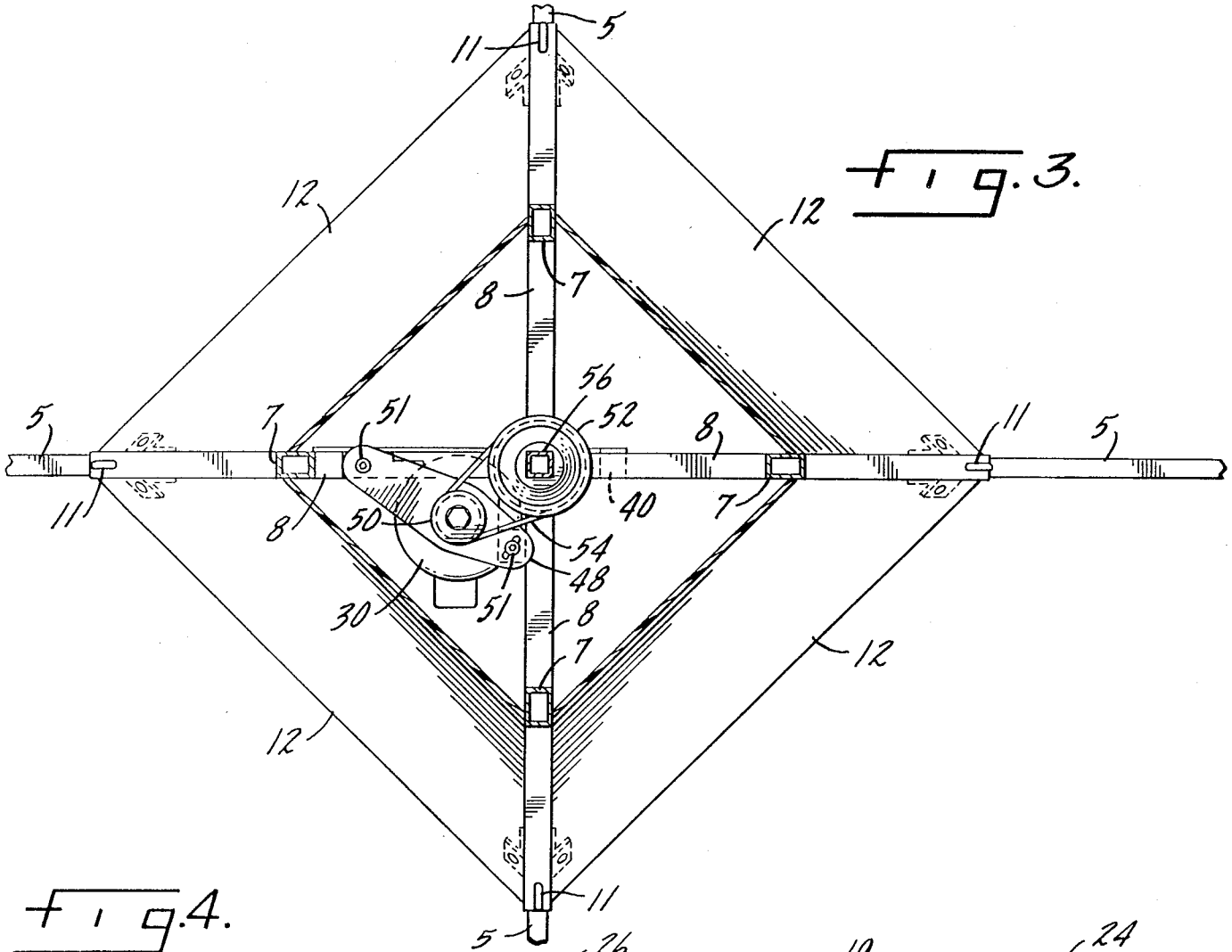
FIG. 3 is a view taken substantially along the line 3—3 of FIG. 2.

A weather shield or hood 12 is secured to support legs 3 and covers the upper portion of the pitching device as shown in FIG. 1. This weather shield or hood can consist of individually mounted sheets as shown in the FIG. 1, or pieces(s) of sheet metal attached to each other and supported by the legs. The pitching device drive mechanism, as illustrated in FIG. 2, is covered and protected by the weather shield. As shown in FIGS. 2 and 3, a crossbar 8 also lies under weather shield 12 and provides structural support to support legs 3 by bracing diagonally opposite support legs to each other.

The support legs are attached at the top to bearing member 13. As shown in FIG. 2, this bearing member provides vertical support to upper drive shaft 15. The top portion of upper drive shaft 15 engages into shaft clamp 17. This shaft clamp 17 has a square receiving portion which slides down over the top square end portion of upper drive shaft 15. Consequently, bar clamp 17 and upper drive shaft 15 can be easily assembled together for batting practice and later disassembled for storage.

As shown in FIG. 1, a hollow rotational shaft 19 is attached to shaft clamp 17 and releasably secured thereto by shaft clamp screws 21. Shaft clamp 17 allows the operator to adjust the shaft length on either side of shaft clamp 17. Preferably, shaft 19 is positioned such that, in use, the weight is about the same on each side of shaft clamp 17.

Figure 4:
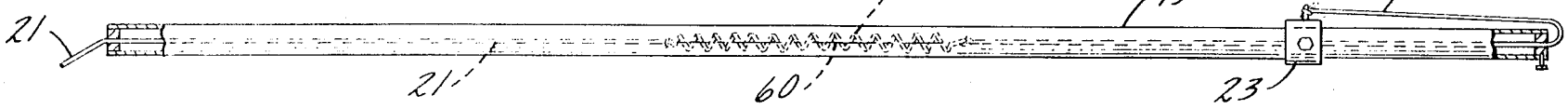
FIG. 4 is a view of the rotational shaft assembly of the preferred embodiment.

As shown in FIG. 4, a tether line adjustment clamp 23 engages the outside surface of shaft 19. Clamp 23 has a line 24 which attaches a first end portion of a spring 26 to clamp 23. Spring 26 lies within hollow rotational shaft 19. The opposite end of spring 26 is connected to a ball 25 by a tether line 21 as illustrated in FIG. 1. Spring 26 is protected from over extension by restraining cord 60 which connects the two spring ends and prevents the spring from extending beyond the length of the restraining cord.

As a result, tether line adjustment clamp 23 can be used to adjust the length of tether line 21 protruding from shaft 19, and thereby adjust the height and radius of the ball path during use. The greater the ball path radius, the faster the ball will travel and the greater the amount of outward force on inner spring 26, assuming the rotational speed of the shaft remains constant. Also, the height of the ball is dependant upon the speed of the rotation and length of tether line protruding from the rotating shaft; consequently, clamp 23 also allows for ball height adjustment.

By allowing the operator to adjust the distance of the ball from the rotational shaft, the operator can choose how far he or she must stand from the device during use. Some batters feel more comfortable when the device is far away; this not only reduces the distraction of the device itself, but also allows for a smoother and straighter entry by the ball into the batter's batting zone. Other batters however may desire the challenge of a smaller circular ball path; they may also wish to stand closer to the device during use and will therefore shorten the radius of the ball path by adjusting clamp 23.

As shown in FIG. 2, shaft 19 is driven by variable speed motor 30. Power for motor 30 is controlled by remote control 32. The variable speed motor used in the preferred embodiment is a heavy duty drill manufactured by The Black and Decker Corporation of Thousand, Md.; this drill is also reversible and the speed control itself is variable. The variable speed motor 30 has a power cord 34 which protrudes from the motor and is connected to a connector means 35. Connector means 35 puts the variable speed motor in electrical connection with remote control mechanism 32. Remote control 32 allows the operator to vary the power to the variable speed motor 30, thus adjusting the rotational speed of shaft 19. This remote control can also stop the shaft by cutting all power to the motor.

Two vertical motor supports 40 are attached to the bottom of crossbar 8 and support motor 30 as illustrated in FIG. 2. A vertical lower drive shaft 42 protrudes upward from motor 30 and is secured to a vertical drive shaft extension 44 by universal joint 46. This drive shaft extension protrudes through pulley support plate 48 and is secured to a horizontal first motor pulley 50. Pully support plate 48 is secured to crossbar 8 by fasteners 51.

As shown in FIG. 3, this motor pully is connected to a horizontal secondary pulley 52 by pulley belt 54. Secondary pulley 52 is secured to upper drive shaft 56 which in turn protrudes through upper bearing member 13. This upper drive shaft is connected to rotational shaft 19 as already discussed above.

FIG. 3 shows the alignment of the variable speed motor 30 with the upper and lower drive shafts 44 and 56, respectively. The tension of pulley belt 54 is adjusted to allow the belt to slip when counter-rotational force is placed upon the rotating drive shafts due to the batting of ball 25. A slipping drive belt has been found to reduce wear on the drive mechanism and provide a rotational pitching device which recovers quickly upon the batting of the rotating ball.

In storing this device, an operator will typically first disassemble the apparatus by disconnecting the remote control at connector means 35. Next, the bar, bar clamp, spring and tethered ball combination is typically lifted off the drive shaft and separated from the base. Finally, the leg clamps are typically loosened, and the leg inserts are separated from the device. As such, these component parts are easy to carry and easy to store.

In setting up the device, the legs are adjusted to their desired heights. This allows batters of different heights to effectively use the machine, and also allows a particular batter to practice hitting a particular type of pitch, i.e., a "high" ball or a "low" ball. The tether clamp is positioned to give the ball the desired height. The speed of the rotation is then set by the remote control. The motor quickly brings the ball to uniform rotational speed. When the ball is struck, the ball will fly outward away from the batter creating tension in the tether line and spring. The spring expands, absorbing the energy of the ball. The spring restraining means keeps the spring from over-extending. Because the spring absorbs energy transferred from the batter to the ball, the bar will experience a lesser amount of counter-rotational energy than it would otherwise encounter without a spring. The bar will slow down but will quickly return to uniform rotational speed. The spring will then retract, returning the ball to its original position. The batter will then be presented, within a relatively short time frame, with another pitch, identical in speed to the proceeding pitch. Hence, the preferred embodiment disclosed a pitching machine which is simple, light weight, easy to set up and break down and yet remarkably effective as a batting practice tool.

The foregoing general discussion and detailed description are intended as illustrative of the present invention and are not to be considered as limiting. Other variations within the scope and spirit of the invention are possible and will present themselves to those skilled in the art.

I claim:

1. An improved baseball pitching device comprising:

a base;

a hollow shaft supported by said base wherein said shaft is capable of rotating with respect to said base;

means for imparting rotation to said shaft;

a clamp adjustably engaged along the length of said shaft;

means securing a ball to said clamp, wherein said means provides an inward force upon said ball in the direction of said base and said means protruding from within said hollow shaft.

2. The improved pitching device of claim 1 wherein said means securing said ball to said clamp includes at least one spring portion.

3. The improved pitching device of claim 2, wherein said clamp is further defined as being adjustably secured to the outer surface of said hollow shaft; and said means securing said ball to said clamp lies within the entire length of said hollow shaft, one end of said means being affixed to said clamp, the other end of said means protruding from said hollow shaft and carrying said ball.

4. The improved pitching device of claim 3 wherein said at least one spring portion lies substantially within said hollow shaft.

5. The improved baseball pitching device of claim 4 wherein said means for imparting rotation comprises a variable speed electric motor.

6. The improved baseball pitching device of claim 5 wherein said variable speed electric motor is reversible.

7. The improved pitching device of claim 6, further comprising a remote control unit connected to said motor through a power cord which regulates the speed of said electric motor.

8. The improved baseball pitching device of claim 7 wherein said base further comprises at least one adjustable support member.

9. The improved baseball pitching device of claim 8 wherein said means securing a ball to said clamp comprises at least one rope.

10. The improved baseball pitching device of claim 9 wherein said shaft is adjustably secured to said base.

11. The improved baseball pitching device of claim 10 wherein said electric motor is a heavy duty drill motor.

12. The improved baseball pitching device of claim 11 wherein said device includes means for preventing said spring from overextending.

13. A baseball pitching practice device comprising:

a base, said base having a vertically extending shaft attached thereto, means in said base for rotating said vertical shaft about its longitudinal axis, said shaft having a substantially horizontal extending hollow shaft attached to its upper end by first clamp means, said first clamp means adjustably attaching said hollow shaft to said vertical shaft for horizontal adjustment along the length of said hollow shaft, tether means extending through said hollow shaft, said tether having one of its ends depending from one end of said hollow shaft and having a ball attached thereto, the other end of said tether depending from the other end of said hollow shaft, second clamp means adjustably fixed along the length of said hollow shaft and having said other end of said tether attached thereto, whereby adjustment of said second clamp means will increase or decrease the distance between said ball and said one end of said hollow shaft.

14. The pitching practice device as defined in claim 13 wherein:

said tether has a tension spring attached intermediate its ends.

15. The pitching practice device as defined in claim 14 wherein:

said tension spring is protected from over extension by means of a restraining cord, said restraining cord having its ends attached to respective ends of said spring and being longer than said spring in its unstretched condition but shorter than the elastic limit length of said spring.

16. The pitching practice device as defined in claim 13 wherein:

said means for rotating said vertical shaft is a variable speed electric motor, the speed of said motor being regulated by a remote control unit.

* * * * *